US006346001B1

(12) United States Patent
Lu et al.

(10) Patent No.: US 6,346,001 B1
(45) Date of Patent: Feb. 12, 2002

(54) COUPLING STRUCTURE FOR MOUNTING CORE OF FLYBACK TRANSFORMER

(75) Inventors: Shao An Lu; Gie Chain Hoang, both of Taoyuan (TW)

(73) Assignee: Darfon Electronics Corp. (TW)

( * ) Notice: Subject to any disclaimer, the term of this patent is extended or adjusted under 35 U.S.C. 154(b) by 0 days.

(21) Appl. No.: 09/591,171

(22) Filed: Jun. 9, 2000

(30) Foreign Application Priority Data

Oct. 14, 1999 (TW) ..... 88117736

(51) Int. Cl.[7] ..... H01R 13/627
(52) U.S. Cl. ..... 439/357
(58) Field of Search ..... 439/352–357, 439/567, 395; 336/90, 92, 192, 198, 208

(56) References Cited

U.S. PATENT DOCUMENTS

| | | | | |
|---|---|---|---|---|
| 3,651,446 A | * | 3/1972 | Sadogierski et al. | 439/357 |
| 4,144,480 A | | 3/1979 | Nagasaki et al. | |
| 4,408,176 A | * | 10/1983 | Nakamura | 336/192 X |
| 4,475,097 A | * | 10/1984 | Kikuchi | 336/192 |
| 5,160,872 A | | 11/1992 | Kenji et al. | |
| 5,180,312 A | * | 1/1993 | Martin | 439/78 |
| 5,287,479 A | | 2/1994 | Masaru et al. | |
| 5,448,216 A | * | 9/1995 | Kuze et al. | 336/90 |
| 5,745,020 A | * | 4/1998 | Shen-Long et al. | 336/92 |
| 5,798,682 A | * | 8/1998 | Kim et al. | 336/192 X |
| 5,921,808 A | * | 7/1999 | Haftmann et al. | 439/495 |
| 6,010,362 A | * | 1/2000 | Caviness et al. | 439/567 |

* cited by examiner

*Primary Examiner*—Brian Sircus
*Assistant Examiner*—Son V. Nguyen
(74) *Attorney, Agent, or Firm*—Oppenheimer Wolff & Donnelly, LLP

(57) ABSTRACT

The present invention provides a coupling structure for mounting a core of a flyback transformer. The flyback transformer comprises a low-voltage bobbin, a housing, a lower core, an upper core and the coupling structure. The low-voltage bobbin comprises a winding shaft and a skirt. The winding shaft has an upper opening for receiving the upper core. The skirt has a lower opening for receiving the lower core. The lower opening defines an internal surface of the skirt. The coupling structure comprises at least one upper coupling device formed on the housing for mounting the upper core and at least one lower coupling device formed on the internal surface of the skirt for mounting the lower core. The upper core is mounted on the housing through the winding shaft by the upper coupling device. The lower core is mounted on the low-voltage bobbin through the skirt by the lower coupling device.

6 Claims, 8 Drawing Sheets

COUPLING STRUCTURE FOR MOUNTING CORE OF FLYBACK TRANSFORMER

FIELD OF THE INVENTION

The present invention relates to a coupling structure, and more particularly, to a coupling structure for mounting a core of a flyback transformer.

BACKGROUND OF THE INVENTION

A flyback transformer is generally implemented within the circuits of a display device for providing distinctive voltages required by the circuits operation of the display device. Some U.S. Pat. Nos. i.e. 5,160,872, 5,287,479 and 4,144,480 may be referred in order to have an in-depth understanding of structures of the flyback transformer and functions of the High Voltage output, Focus output and Screen output of the flyback transformer.

Please refer to FIGS. 1 and 2. FIG. 1 is a schematic diagram of a flyback transformer 10 according to the prior art. FIG. 2 is an exploded diagram of the flyback transformer 10 shown in FIG. 1. Flyback transformer 10 of the prior art comprises a low-voltage bobbin 12, a high-voltage bobbin 14, an upper core 16, a lower core 18, a housing 20 and a clip 22. The assembly procedure of the flyback transformer 10 comprises: first, installing a winding shaft (not shown) of the low-voltage bobbin 12 into a shaft hole (not shown) of the high-voltage bobbin 14; secondly, installing the low-voltage bobbin 12 and high-voltage bobbin 14 into the housing 20; thirdly, installing the upper and lower cores 16, 18 on the low-voltage bobbin 12 respectively; finally, mounting the upper and lower cores 16, 18 by the clip 22 to form the flyback transformer 10.

In general, a clip 22 made of nonmagnetic metallic material is used to mount the upper and lower cores 16, 18 on the low-voltage bobbin 12 within the assembly procedure of the flyback transformer 10. The purpose is to apply the flexibility of the clip 22 for mounting the upper and lower cores 16, 18 on the low-voltage bobbin 12. However, the use of clip 22 increases the product cost, and more particularly, an additional assembly step is required during the assembly procedure of the flyback transformer 10.

SUMMARY OF THE INVENTION

The present invention provides a coupling structure for mounting a core of a flyback transformer. The flyback transformer comprises a low-voltage bobbin, a housing, a lower core, an upper core and the coupling structure. The low-voltage bobbin comprises a winding shaft and a skirt. The winding shaft has an upper opening for receiving the upper core. The skirt has a lower opening for receiving the lower core. An internal surface of the skirt is defined by the lower opening. The coupling structure comprises at least one upper coupling device provided on the housing for mounting the upper core and at least one lower coupling device provided on the internal surface of the skirt for mounting the lower core. Besides, the upper core engages into the housing by the upper coupling device through the winding shaft and the lower core engages into the low-voltage bobbin by the lower coupling device through the skirt according to a predetermined procedure. Therefore, the flyback transformer applied with the coupling structure of the present invention will no longer apply said clip. The product cost will be reduced and the additional step in the assembly procedure of the flyback transformer will be removed as well.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
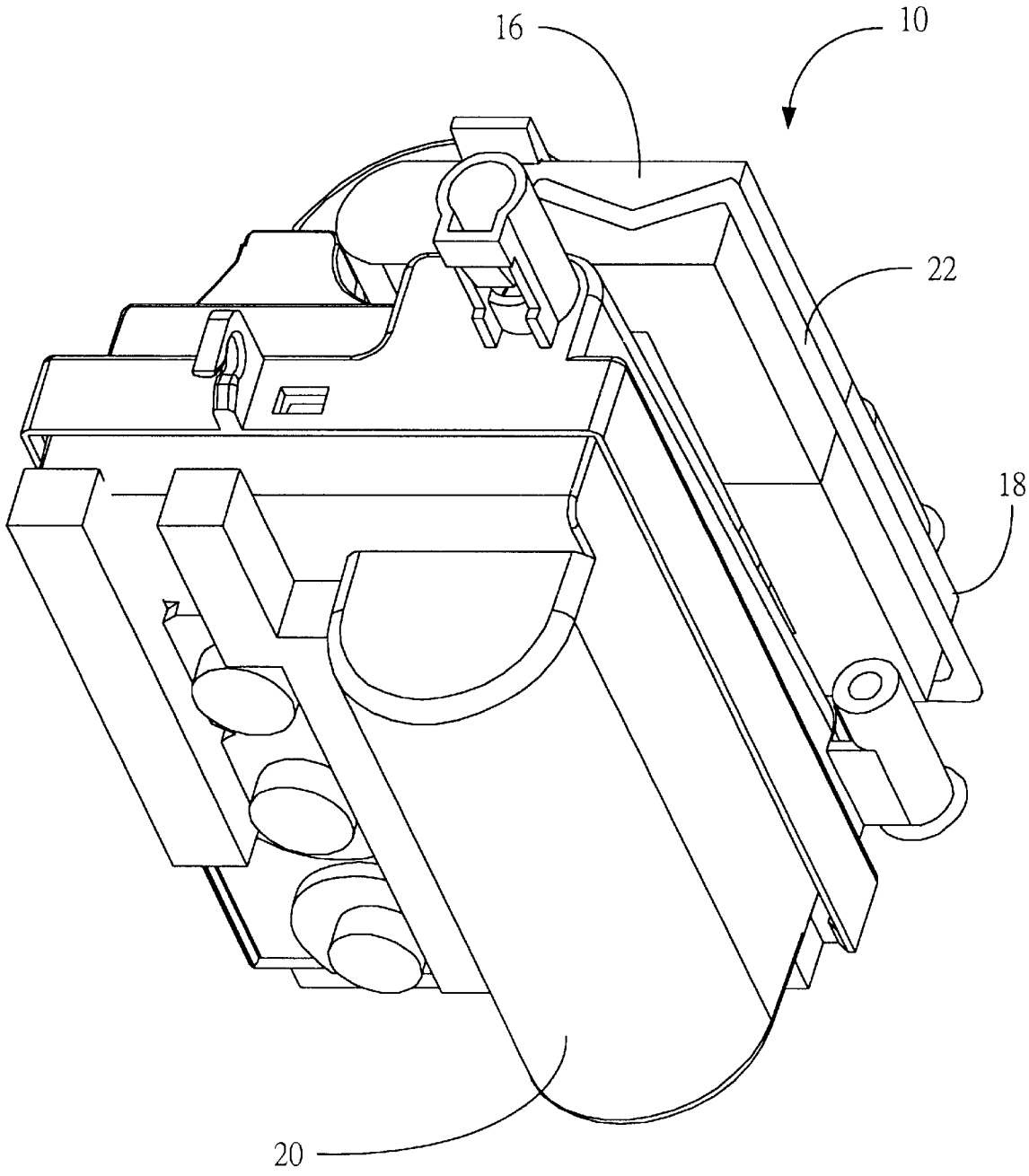
Fig. 1 Prior Art
FIG. 1 is a schematic diagram of a flyback transformer according to the prior art.
Figure 2:
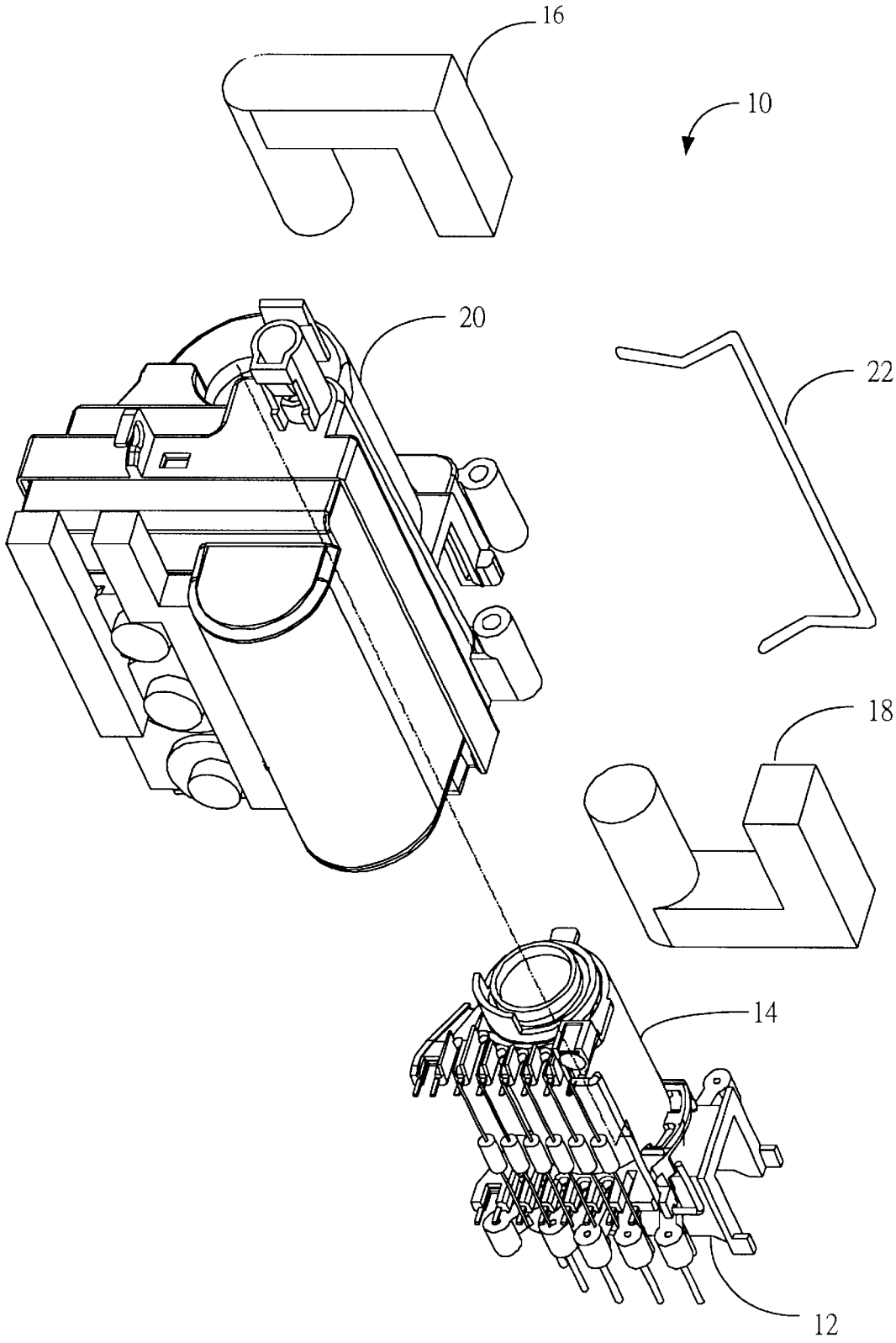
Fig. 2 Prior Art
FIG. 2 is an exploded diagram of the flyback transformer shown in FIG. 1.
Figure 3:
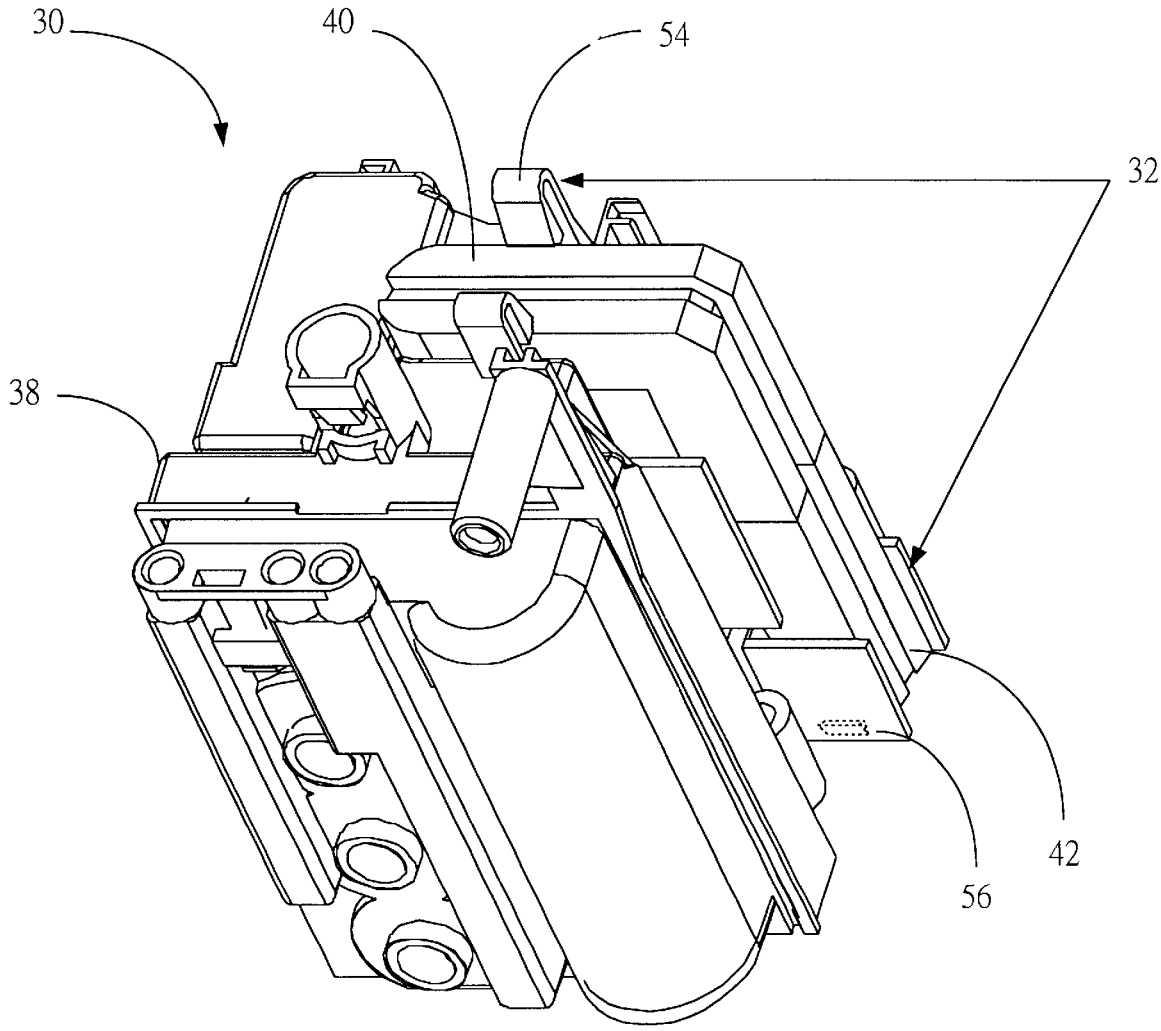
FIG. 3 is a schematic diagram of a flyback transformer applied with a coupling structure of the present invention.
Figure 4:
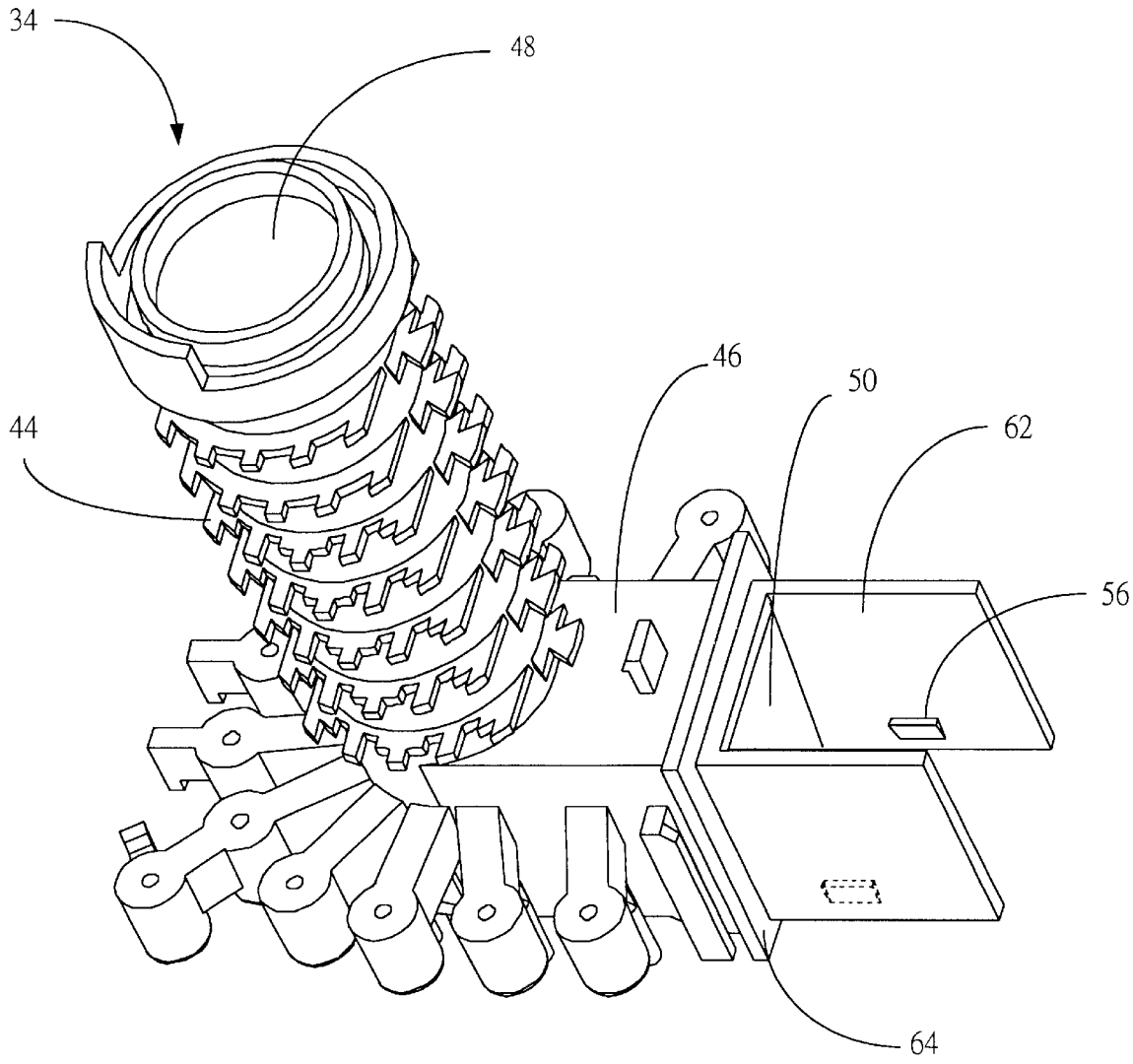
FIG. 4 is a schematic diagram of a first embodiment in the lower coupling device shown in FIG. 3.

Please refer to FIGS. 3 and 4. FIG. 3 is a schematic diagram of a flyback transformer 30 applied with a coupling structure 32 of the present invention. FIG. 4 is a schematic diagram of a first embodiment in the lower coupling device 56 shown in FIG. 3. The present invention provides a coupling structure 32 for mounting a core of a flyback transformer 30. The flyback transformer 30 comprises a low-voltage bobbin 34, a high-voltage bobbin (not shown), a housing 38, an upper core 40, a lower core 42 and the coupling structure 32. The low-voltage bobbin 34 comprises a winding shaft 44 and a skirt 46. The winding shaft 44 has an upper opening 48 for receiving the upper core 40. The skirt 46 has a lower opening 50 for receiving the lower core 42.

The coupling structure 32 comprises two upper coupling devices 54, two faceplates 62 and two lower coupling devices 56. Each upper coupling device 54 is integrally formed on the housing 38 for mounting the upper core 40. Each faceplate 62 is integrally formed on a corresponding flange 64 of the skirt 46 respectively. The lower coupling devices 56 are integrally formed on the corresponding faceplate 62 for mounting the lower core 42 respectively. The upper core 40 engages into the housing 38 through the winding shaft 44 by the upper coupling devices 54. The lower core 42 engages into the low-voltage bobbin 34 through the skirt 46 by the lower coupling devices 56.

Figure 5:
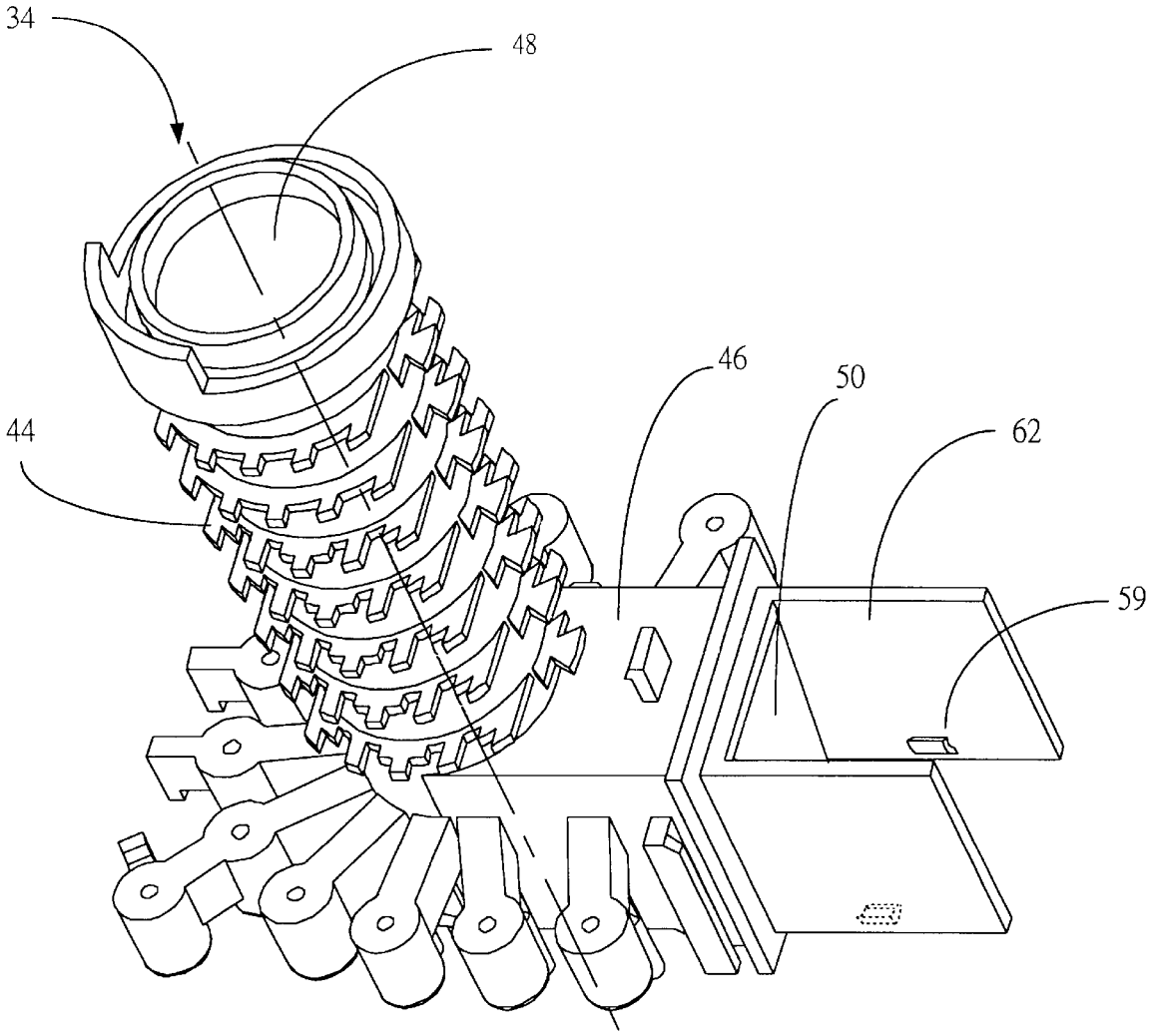
FIG. 5 is a schematic diagram of a second embodiment in the lower coupling device shown in FIG. 3.
Figure 6:
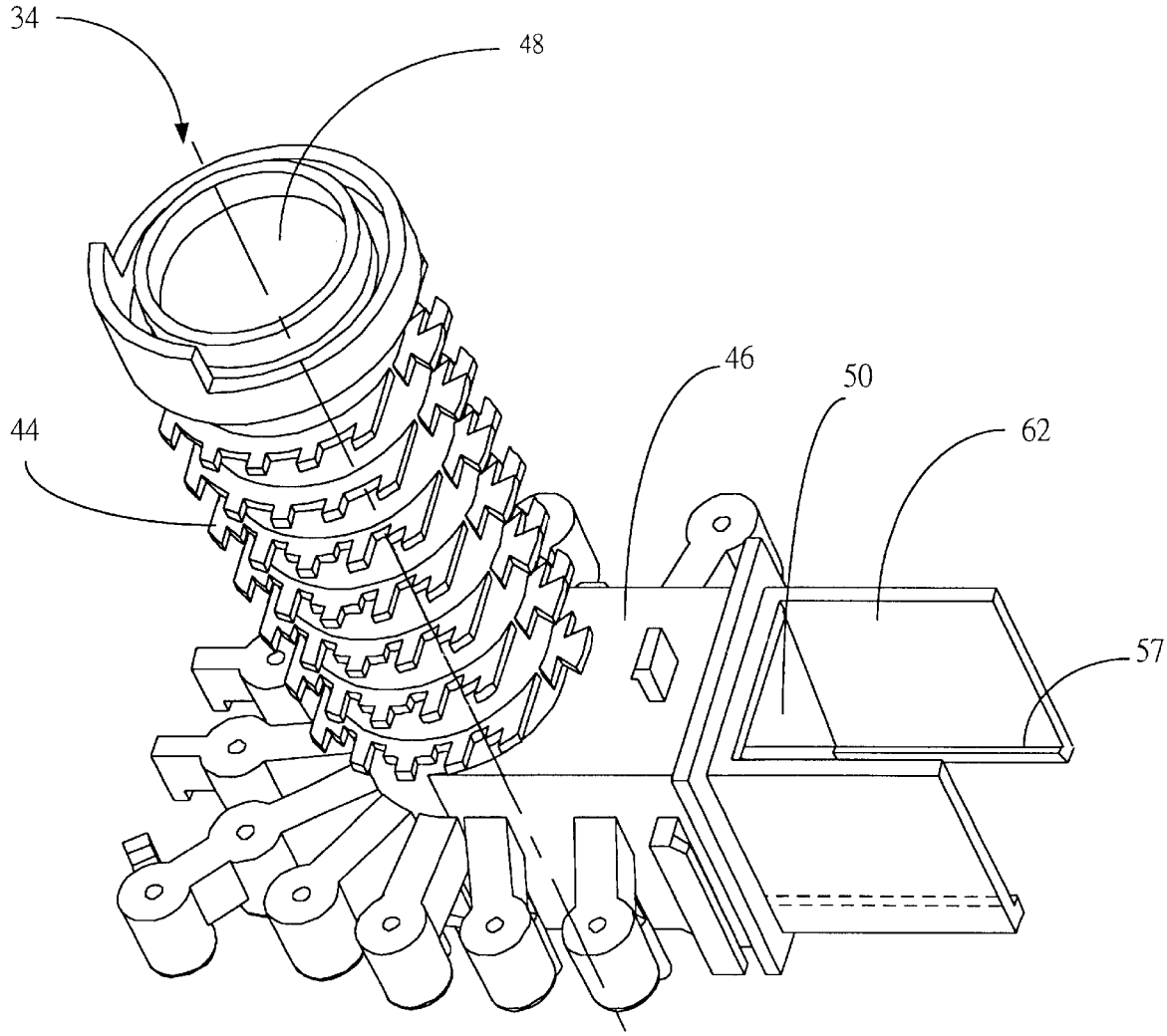
FIG. 6 is a schematic diagram of a third embodiment in the lower coupling device shown in FIG. 3.

Please refer to FIG. 3 through FIG. 6. FIG. 5 is a schematic diagram of a second embodiment in the lower coupling device 59 shown in FIG. 3. FIG. 6 is a schematic diagram of a third embodiment in the lower coupling device 57 shown in FIG. 3. Each upper coupling device 54 could be a barb for mounting the upper core 40 as shown in FIG. 3. Each lower coupling device 56 could be a triangular prism for mounting the lower core 42 as shown in FIG. 4. In addition, each lower coupling device 59 could be a hook for mounting the lower core 42 as shown in FIG. 5. Furthermore, each lower coupling device 57 could be a rectangular prism for mounting the lower core 42 as shown in FIG. 6.

Figure 7:
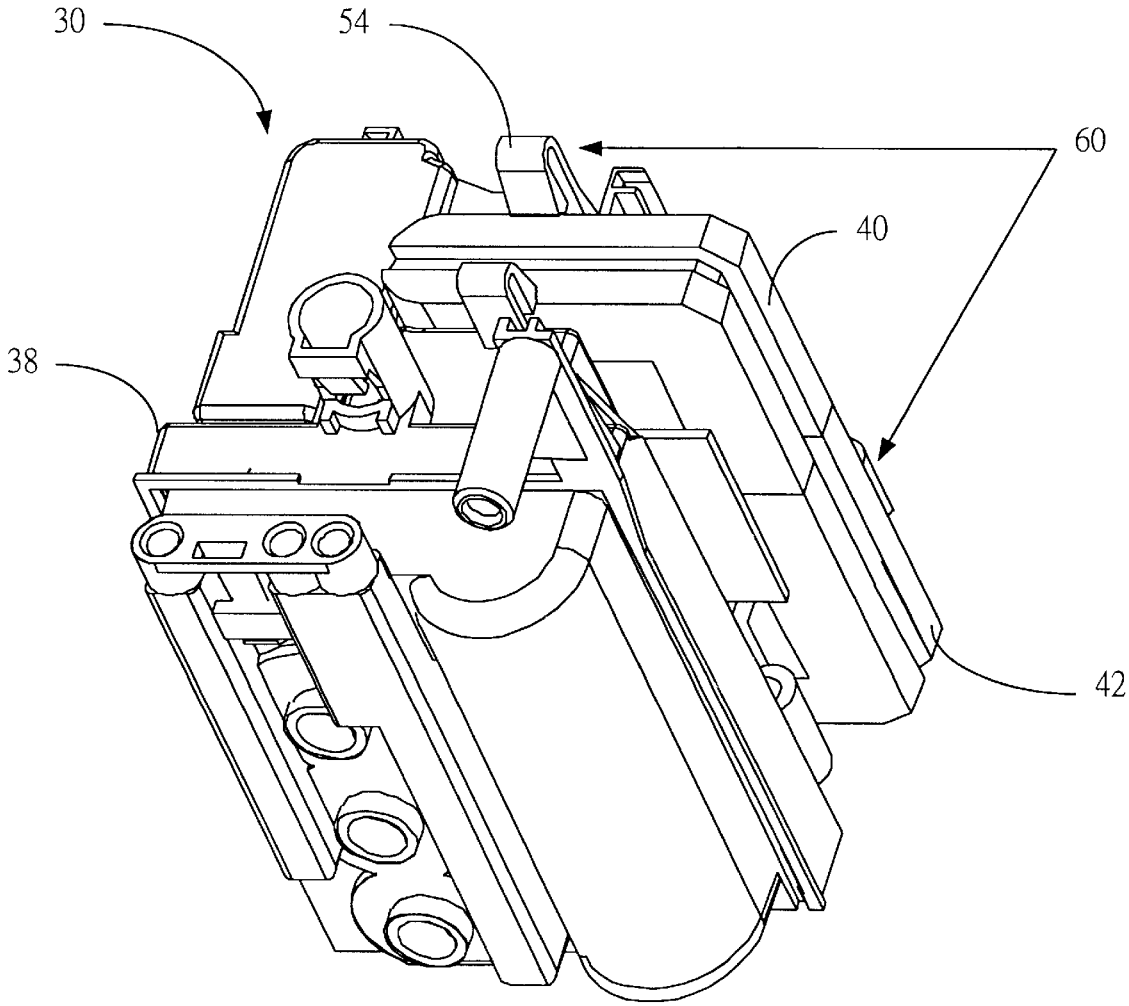
FIG. 7 is a schematic diagram of another flyback transformer applied with a coupling structure of the present invention.
Figure 8:
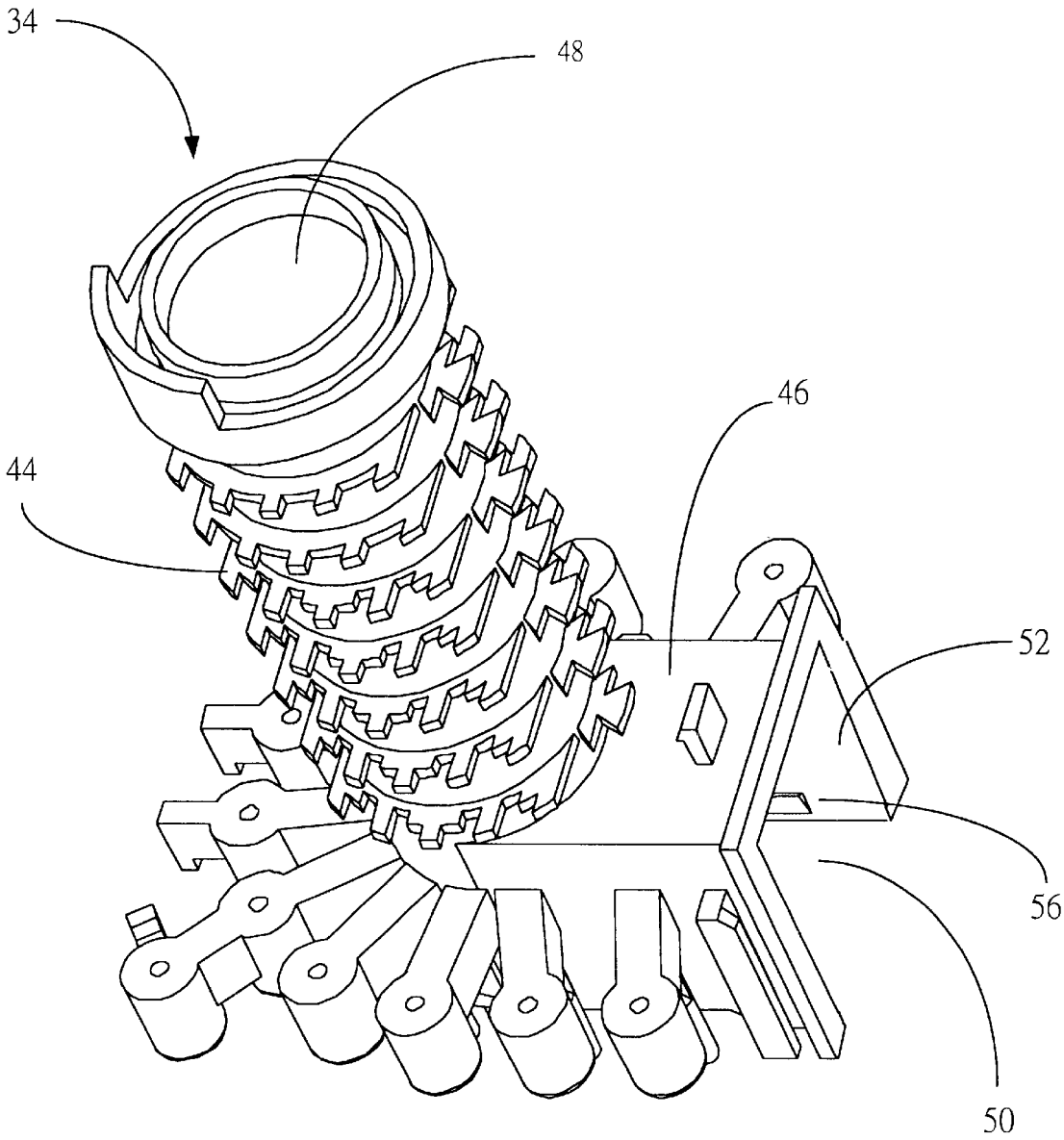
FIG. 8 is a schematic diagram of a lower coupling device in the coupling structure shown in FIG. 7.

Please refer to FIG. 7 and FIG. 8. FIG. 7 is a schematic diagram of another flyback transformer 30 applied with a coupling structure 60 of the present invention. FIG. 8 is a schematic diagram of a lower coupling device 56 in the coupling structure 60 shown in FIG. 7. The present invention also provides a coupling structure 60 comprising two upper coupling devices 54 and two lower coupling devices 56. Each upper coupling device 54 is integrally formed on the housing 38 for mounting the upper core 40. Each lower coupling device 56 is integrally formed on an internal surface 52 of the skirt 46 for mounting the lower core 42, wherein the internal surface 52 is defined by the lower opening 50 of the skirt 46. The upper core 40 engages into the housing 38 through the winding shaft 44 by the upper coupling devices 54. The lower core 42 engages into the low-voltage bobbin 34 through the skirt 46 by the lower coupling devices 56.

Please refer to FIG. 5 through FIG. 8. Each upper coupling device 54 of the coupling structure 60 in this embodiment could be a barb shown in FIG. 7. Next, each lower coupling device 56 could be a triangular prism shown in FIG. 8. Furthermore, each lower coupling device 59 could be a hook such as FIG. 5. Finally, each lower coupling device could be a rectangular prism such as FIG. 6.

The assembly procedure of the low-voltage bobbin 30 applied with the coupling structure 32, 60 of the present invention comprises: first, installing the winding shaft 44 of the low-voltage bobbin 34 into a hole (not shown) of the high-voltage bobbin (not shown); secondly, installing the high-voltage bobbin and low-voltage bobbin 34 into the housing 38; finally, mounting the upper core 40 on the housing 38 through the winding shaft 44 by the upper coupling device 54, and concurrently mounting the lower core 42 on the low-voltage bobbin 34 through the skirt 46 by the lower coupling devices 56, 57, 59.

In comparison with the clip 22 of the flyback transformer 10 according to the prior art, the coupling structures 32, 60 of the present invention comprise two upper coupling devices 54 integrally formed on the housing 38 and two lower coupling devices 56, 57, 59 integrally formed on the two faceplates 62 or the internal surface 52 of the skirt 46 respectively. The upper core 40 could be mounted on the housing 38 through the winding shaft 44 by the upper coupling devices 54, and the lower core 42 could be mounted on the low-voltage bobbin 34 through the skirt 46 by the lower coupling devices 56, 57, 59. Therefore, said clip 22 of the prior art will not be a necessary component for mounting the upper and lower cores 40, 42. The product cost of the flyback transformer 30 applied with the coupling structure 32, 60 will be reduced. In addition, the assembly time of the flyback transformer 30 will be reduced because of the removal of the assembly step of clip 22 according to the present invention.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A coupling structure for mounting a core of a flyback transformer, the flyback transformer comprising the core, a low-voltage bobbin, a housing, and the coupling structure, the core comprising an upper core and a lower core, the lower-voltage bobbin comprising a skirt and a winding shaft, the skirt having a lower opening for receiving the lower core, the winding shaft being provided on the skirt and having an upper opening for receiving the upper core, the coupling structure comprising:

at least one upper coupling device formed on the housing for mounting the upper core;

at least one faceplate integrally formed on a corresponding flange of the skirt respectively; and at least one lower coupling device formed on at least one said faceplate for mounting the lower core.

2. The coupling structure of claim 1 wherein the upper coupling device is integrally formed on the housing and the lower coupling device is integrally formed on the corresponding faceplate.

3. The coupling structure of claim 2 wherein the upper core engages into the housing through the winding shaft and the lower core engages into the low-voltage bobbin through the skirt.

4. A coupling structure for mounting a core of a flyback transformer, the flyback transformer comprising the core, a low-voltage bobbin, a housing, and the coupling structure, the core comprising an upper core and a lower core, the low-voltage bobbin comprising a skirt and a winding shaft, the skirt having a lower opening for receiving the lower core, the lower opening defining an internal surface of the skirt, the winding shaft being provided on the skirt and having an upper opening for receiving the upper core, the coupling structure comprising:

at least one upper coupling device formed on the housing for mounting the upper core; and at least one lower coupling device formed on the internal surface of the skirt for mounting the lower core.

5. The coupling structure of claim 4 wherein the upper coupling device is integrally formed on the housing and the lower coupling device is integrally formed on the internal surface of the skirt.

6. The coupling structure of claim 5 wherein the upper core engages into the housing through the winding shaft and the lower core engages into the low-voltage bobbin through the skirt.

* * * * *